US012716260B2

(12) United States Patent
Song

(10) Patent No.: US 12,716,260 B2
(45) Date of Patent: Aug. 25, 2026

(54) FOLDABLE TENT FRAMEWORK AND TENT

(71) Applicant: Ningbo Dongrun Mining Co., Ltd., Ningbo City (CN)

(72) Inventor: Libo Song, Ningbo City (CN)

(73) Assignee: Ningbo Dongrun Mining Co., Ltd., Ningbo City (CN)

( * ) Notice: Subject to any disclaimer, the term of this patent is extended or adjusted under 35 U.S.C. 154(b) by 124 days.

(21) Appl. No.: 18/346,580

(22) Filed: Jul. 3, 2023

(65) Prior Publication Data

US 2023/0349191 A1 Nov. 2, 2023

(30) Foreign Application Priority Data

May 17, 2023 (CN) ..... 202321235651.X

(51) Int. Cl.
*E04H 15/50* (2006.01)
*E04H 15/60* (2006.01)

(52) U.S. Cl.
CPC ..... *E04H 15/50* (2013.01); *E04H 15/60* (2013.01)

(58) Field of Classification Search
CPC ..... E04H 15/50
See application file for complete search history.

(56) References Cited

U.S. PATENT DOCUMENTS 4,558,713 A * 12/1985 Hagler ..... E04H 15/34 135/159
6,708,707 B2 * 3/2004 Dotterweich ..... E04H 15/50 135/159
11,732,496 B1 * 8/2023 Urhausen ..... E04B 7/08 135/124
12,084,879 B2 * 9/2024 Yang ..... E04H 15/54
2004/0084074 A1 * 5/2004 Chiu ..... E04H 15/50 135/131
2006/0162759 A1 7/2006 Choi
2007/0221262 A1 9/2007 Tsai et al.
2008/0066795 A1 * 3/2008 Sy-Facunda ..... E04H 15/50 135/145
2016/0348392 A1 12/2016 Jin
2018/0202185 A1 7/2018 Choi
2019/0368220 A1 12/2019 Sun et al.
2022/0178162 A1 * 6/2022 Wu ..... E04H 15/48
2024/0318456 A1 * 9/2024 Ling ..... E04H 15/405

FOREIGN PATENT DOCUMENTS

WO WO-2005024158 A1 * 3/2005 ..... E04H 15/46

* cited by examiner

*Primary Examiner* — Noah Chandler Hawk

(57) ABSTRACT

A foldable tent framework includes upright roles, side pole assemblies, first hip rafters, top connecting member and second hip rafters. Each second hip rafter includes a second upper hip rafter and a second lower hip rafter that are articulated with each other, the second lower hip rafter includes at least two sets of inclined hip rafters arranged in parallel, when being folded, the two sets of inclined hip rafters are relatively rotated along their respective upper ends to close to each other, thereby making their lower ends close to each other along with the folding of the side pole assemblies, and the second lower hip rafter is rotated relative to the second upper hip rafters and the side pole assemblies on the whole to form a folded state.

3 Claims, 12 Drawing Sheets

FOLDABLE TENT FRAMEWORK AND TENT

TECHNICAL FIELD

The disclosure pertains to the field of outdoor supplies, and specifically pertains to a foldable tent framework and a tent.

BACKGROUND

Tents are equipment used by people for outdoor camping, and are divided into various forms, such as frame type, inflatable type, and the like, according to their structures. A frame tent can be made into a small tent for 1-3 persons to sleep, or a large tent for 10-20 persons to rest, and the frame tent generally has a foldable function, that is, after being unfolded, the frame can be covered with a tent fabric to form a tent.

For a foldable frame tent, the tent fabric is supported at the perimeter of its top surface, which leads to the accumulation of rainwater, being detrimental to the aesthetics and practicality of the tent. Moreover, the frame is not very stable and prone to shaking. In the prior art, a tent framework supported by a single spoke on the top surface is available, which has a relatively better effect but fails to solve the above problems fundamentally, only the water accumulation in a large scale is shrunk.

Therefore, it is necessary to develop a foldable tent framework featuring stable structure, capable of avoiding water accumulation and without affecting the folding and unfolding functions thereof.

SUMMARY

The disclosure aims to provide a foldable tent framework and a tent which are conducive to drainage to avoid water accumulation and are easy to use.

As a first aspect of the disclosure, a foldable tent framework and a tent are provided, including:

upright poles, side pole assemblies connected between the adjacent upright poles, first hip rafters, and a top connecting member, two ends of each first hip rafter respectively connected to one upright pole and the top connecting member, and each second hip rafter including a second upper hip rafter and a second lower hip rafter, where an upper end of each second upper hip rafter is connected to the top connecting member, each second lower hip rafter includes at least two sets of inclined hip rafters arranged in parallel, upper ends of the two sets of inclined hip rafters are articulated with lower ends of the second upper hip rafter, and lower ends of the two sets of inclined hip rafters are respectively connected to articulated points at two sides of the side pole assembly.

The adjacent upright poles are relatively far away from to make the foldable tent framework been in an unfolded state, the adjacent upright poles are relatively close to one another to make the foldable tent framework been in a folded state. When in a folded state, the two sets of inclined hip rafters are relatively rotated along their respective upper ends to close to each other, and lower ends thereof are close to each other with the folding of the side pole assemblies, and two ends of the second lower hip rafter are respectively rotated relative to the second upper hip rafter and the side pole assemblies for folding.

As a second aspect of the disclosure, a foldable tent framework and a tent are provided, including:

a plurality of upright poles, and a plurality of side pole assemblies connected between the adjacent upright poles, and a plurality of first hip rafters, where upper ends of the first hip rafters are articulated with one another, and lower ends thereof are connected with the upright poles; and a plurality of second hip rafters, where the second hip rafters are disposed between the adjacent first hip rafters, upper ends of the second hip rafters are articulated with the upper ends of the first hip rafters, and lower ends of the second hip rafters are connected with the side pole assembly located between the adjacent first hip rafters.

Each second hip rafter includes a second upper hip rafter and a second lower hip rafter, where an upper end of each second upper hip rafter is formed as the upper end of the second hip rafter, the second lower hip rafter includes at least two sets of inclined hip rafters arranged in parallel, upper ends of the two sets of inclined hip rafters are articulated with lower ends of the second upper hip rafter, a first articulated point and a second articulated point are respectively formed on both sides of the side pole assembly, and lower ends of the two sets of inclined hip rafters are respectively connected to the first articulated point and the second articulated point.

The adjacent upright poles are relatively far away from to make the foldable tent framework been in an unfolded state, the adjacent upright poles are relatively close to one another to make the foldable tent framework been in a folded state. When in a folded state, the two sets of inclined hip rafters are relatively rotated along their respective upper ends to close to each other, and lower ends thereof are close to each other with the folding of the side pole assemblies, and two ends of the second lower hip rafter are respectively rotated relative to the second upper hip rafter and the side pole assemblies for folding.

As a third aspect of the disclosure, a tent is provided, including the foldable tent framework and a tarpaulin covering the foldable tent framework.

The Tent Framework and the Tent Made Thereby of the Disclosure have the Following Beneficial Effects:

1. With folded and unfolded states, the tent framework can be easily switched between a folded state and an unfolded state, and is convenient to operation.
2. Second hip rafters are disposed on the top surface to support the tent fabric, so that it is not easy to accumulate water; moreover, after the second hip rafters are disposed, the folding and unfolding processes of the tent framework are not affected.
3. Shapes of the second hip rafters are adapted to the top surfaces where they are respectively located, so that the supporting effect of the tent fabric at the lower end is better than that at the upper end, and requirements of preventing water accumulation and unfolding stability of the framework can be both satisfied.
4. The arrangement of the connecting hip rafters can improve the matching adaptability between the inclined hip rafters and the second side pole member, which is conducive to the design and manufacture of the product. Moreover, the arrangement of the connecting hip rafters can make the positions of the upper connecting points of the two inclined hip rafters lower, which is conducive to the downward movement of the triangular area formed by the two inclined hip rafters and the second side pole member, further improving the water resistance.
5. The connecting hip rafters may be disposed in a way of protruding from the connecting point of the connecting hip rafters and the two inclined hip rafters, so that the rainwater can flow out more easily, without any accumulation.

Figure 1:
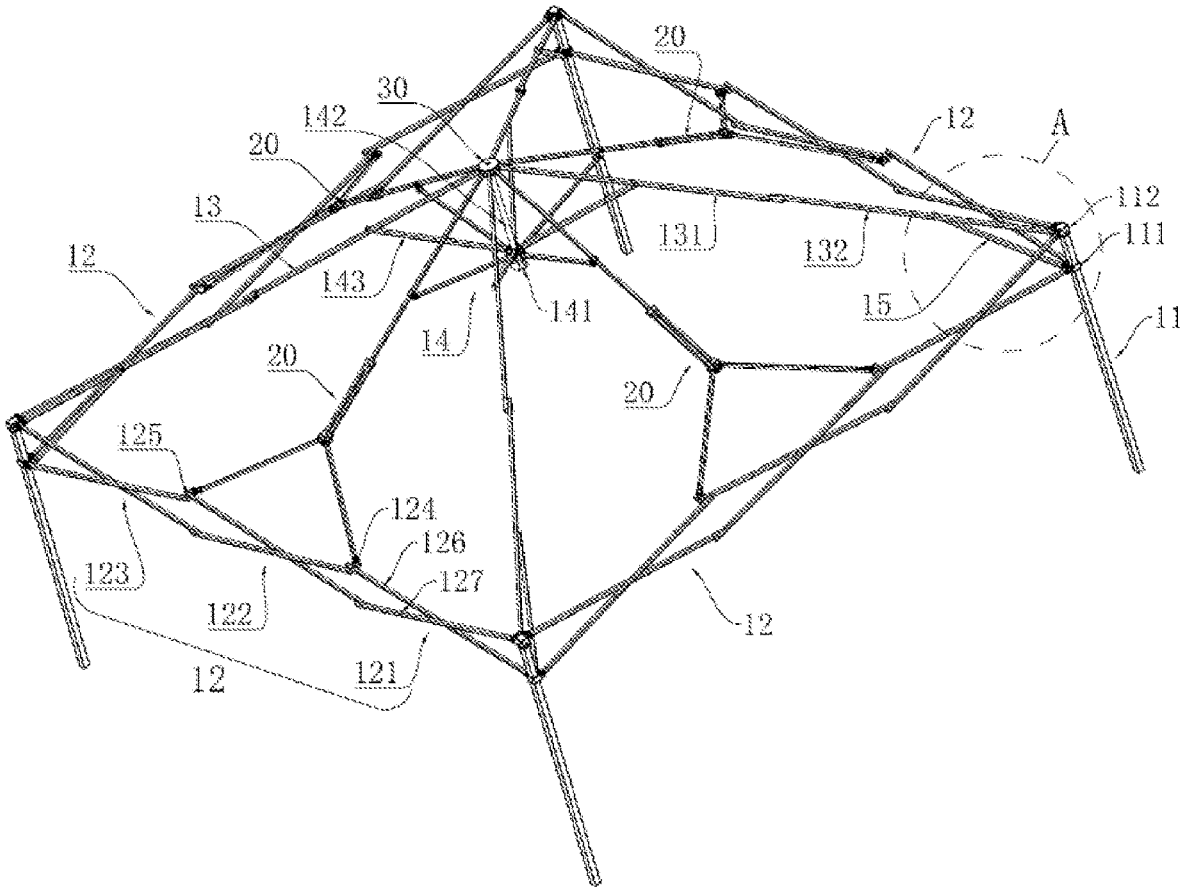
FIG. 1 is a structural schematic diagram of a tent framework in an unfolded state according to Embodiment 1 of the disclosure.
Figure 2:
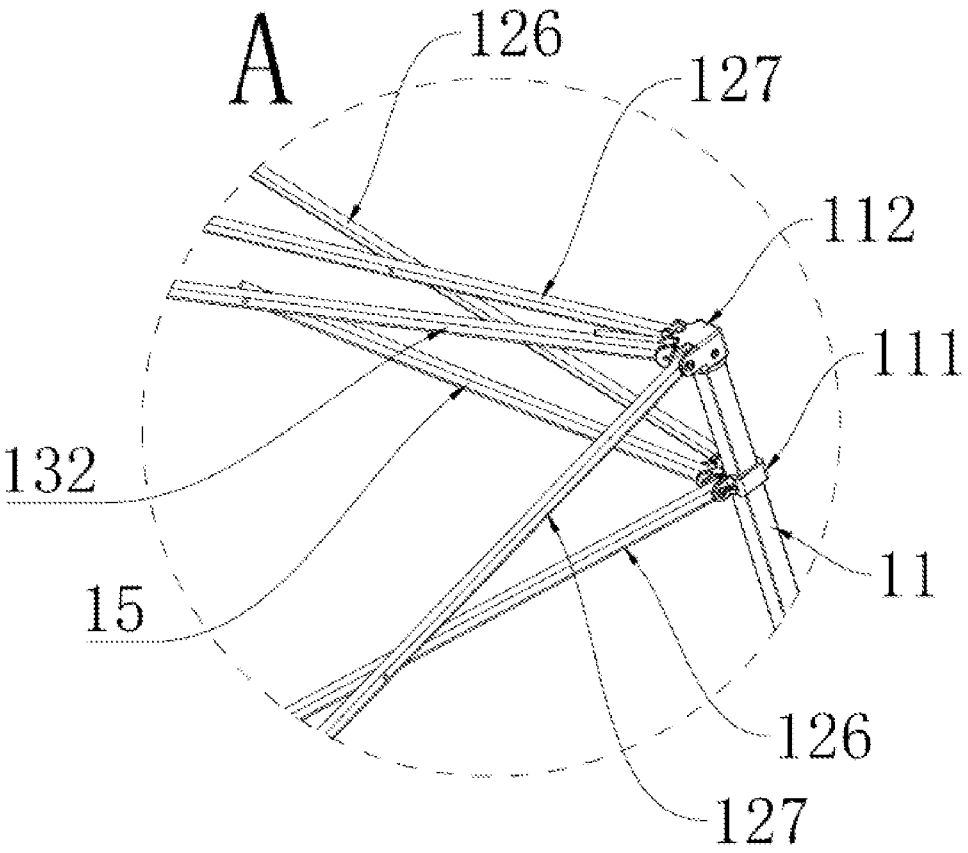
FIG. 2 is an enlarged schematic diagram at a portion A in FIG. 1.

In the accompanying drawings, upright pole 11, side pole assembly 12, first hip rafter 13, top locking mechanism 14, bottom supporting pole 15, second hip rafter 20, second upper hip rafter 21, second lower hip rafter 22, second articulated member 23, multi-directional articulated member 24, top connecting member 30, first axis 101, second axis 102, third axis 103, fourth axis 104, first slidable seat 111, first articulated seat 112, first side pole member 121, second side pole member 122, third side pole member 123, first articulated point 124, second articulated point 125, first side pole 126, second side pole 127, first upper hip rafter 131, first lower hip rafter 132, locking member 141, locking vertical bar 142, locking supporting pole 143, connecting hip rafter 221, inclined hip rafter 222, first connecting end 231, second articulated seat 232, first articulated groove 233, second articulated groove 241, and articulated hole 242.

DESCRIPTION OF THE EMBODIMENTS

Specific structure of the disclosure will be described in detail in conjunction with a plurality of embodiments for a better understanding of the disclosure.

Embodiment 1

As shown in FIG. 1, a foldable tent framework includes upright poles 11, side pole assemblies 12, first hip rafters 13 and a top connecting member 30. The side pole assemblies 12 are connected between two adjacent upright poles 11, two ends of each first hip rafters 13 are respectively connected to one upright pole 11 and the top connecting member 30, and the tent framework can be folded from an unfolded state shown in FIG. 1 to a folded state by making the two adjacent upright poles 11 approach each other.

In this embodiment, each first hip rafter 13 includes a first upper hip rafter 131 and a first lower hip rafter 132. The upper end of each first upper hip rafter 131 is connected to the upper and lower ends of the top connecting member 30, and is articulated with the upper end of the first lower hip rafter 132, and the lower end of the first lower hip rafter 132 is connected to the upright pole 11, such that when the first hip rafter 13 is in a straight pole state in an unfolded stated, the first upper hip rafters 131 and the first lower hip rafter 132 are folded in half in a folded state. Preferably, the length of the first upper hip rafter 131 is basically equal to that of the first lower hip rafter 132, so that the top connecting member 30 is at the top of the upright poles 11 in the folded state; basically equal length includes a slightly longer of one of them thereof.

In this embodiment, the tent framework is further provided with second hip rafters 20, where each second hip rafter 20 includes a second upper hip rafter 21 located at its upper part and a second lower hip rafter 22 located at its lower part. The upper part and the lower part are in a relative positional relationship, and proportions of their respective lengths are not required to be the same. Further, the second upper hip rafter 21 and the second lower hip rafter 22 can be either a single rafter member, or a combined rafter member formed by a plurality of rafter members in series or in parallel, which is not limited.

Figure 3:
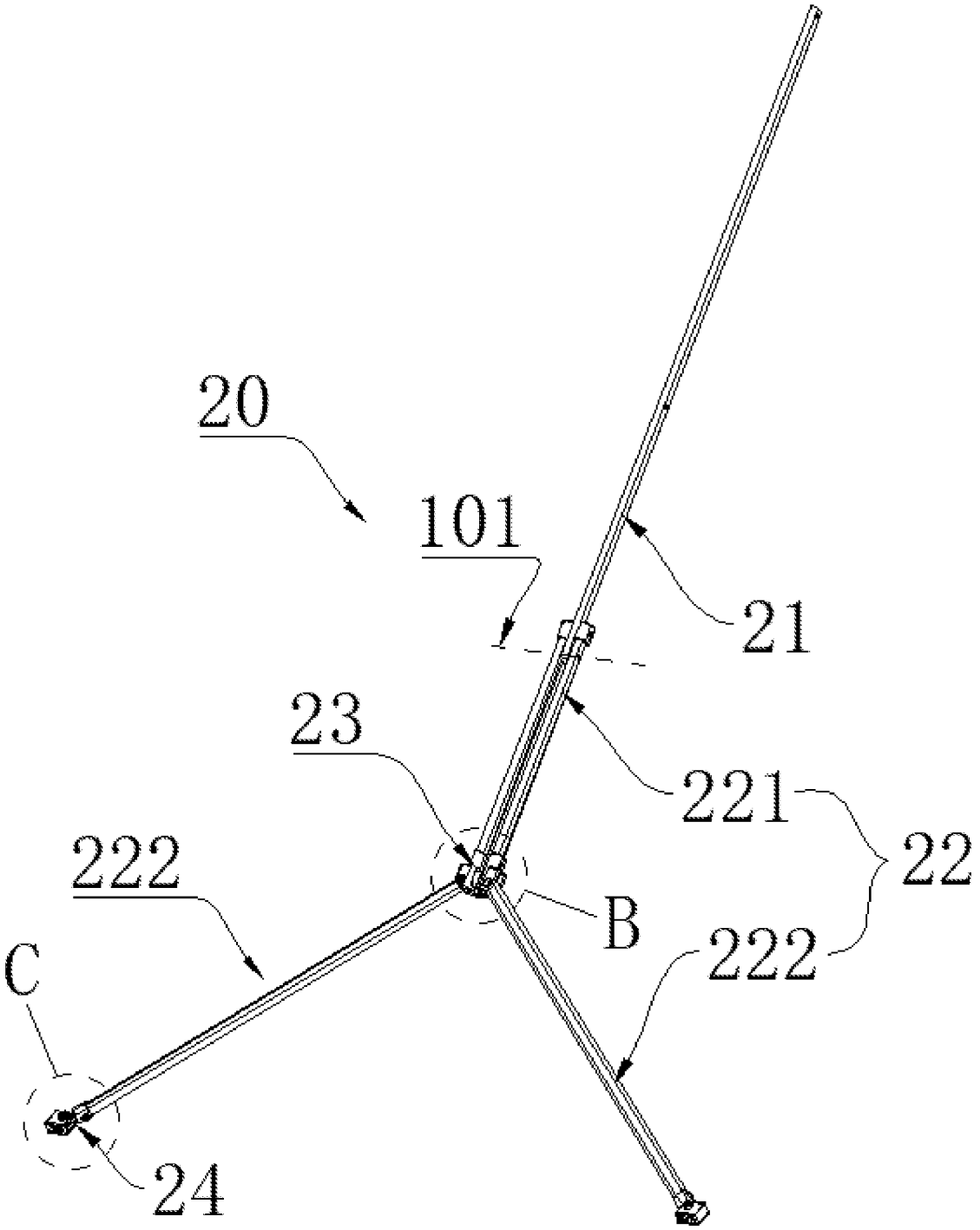
FIG. 3 is a structural schematic diagram of a second hip rafter of an embodiment in FIG. 1.

As shown in FIG. 3, the second upper hip rafter 21 and the second lower hip rafter 22 are articulated with each other to allow the two to rotate relative to each other for folding. The second lower hip rafter 22 further includes a connecting hip rafter 221 and two inclined hip rafters 222, where the connecting hip rafter 221 includes two connecting rafters arranged in parallel to clamp the second upper hip rafter 21 between them in an articulated manner, the two inclined hip rafters 222 are respectively articulated with the lower end of the connecting hip rafter 221, so as to allow the lower ends of the two inclined hip rafters 222 to be relatively unfolded to move away from each other or to be relatively close to each other for folding. In the unfolded state, the two inclined hip rafters 222 and a portion of one side pole assembly 12 form a triangular shape; in the folded state, the two inclined hip rafters 222 are relatively close together to form a parallel combined rafter side by side or a combined rafter with a very small angle, and the combined rafter is folded relative to the second upper hip rafter 21 to approach.

For this reason, the connecting hip rafter 221 and the inclined hip rafters 222 are connected by a second articulated member 23, the second articulated member 23, on the one hand, is fixedly connected to the lower end of the connecting hip rafter 221, and on the other hand, is articulated with the upper ends of the two inclined hip rafters 222. Further, each side pole assembly 12 includes a first side pole member 121, a second side pole member 122 and a third side pole member 123 that are articulated in sequence, a first articulated point 124 is formed between the first side pole member 121 and the second side pole member 122, a second articulated point 125 is formed between the second side pole member 122 and the third side pole member 123, and lower ends of the two inclined hip rafters 222 are respectively connected with the first articulated point 124 and the second articulated point 125, and the connection point is formed in a multi-directional or universal connection relationship. The universal connection relationship refers to a connection by using a ball joint mechanism and other universal connection mechanisms, the multi-directional connection relationship refers to mutual articulation between two or more non-parallel articulated shafts, so as to allow relative unfolding or folding between the two inclined hip rafters 222 of the second lower hip rafter 22, and the rotation of the second lower hip rafter 22 relative to the side pole assembly 12 for folding.

Figure 4:
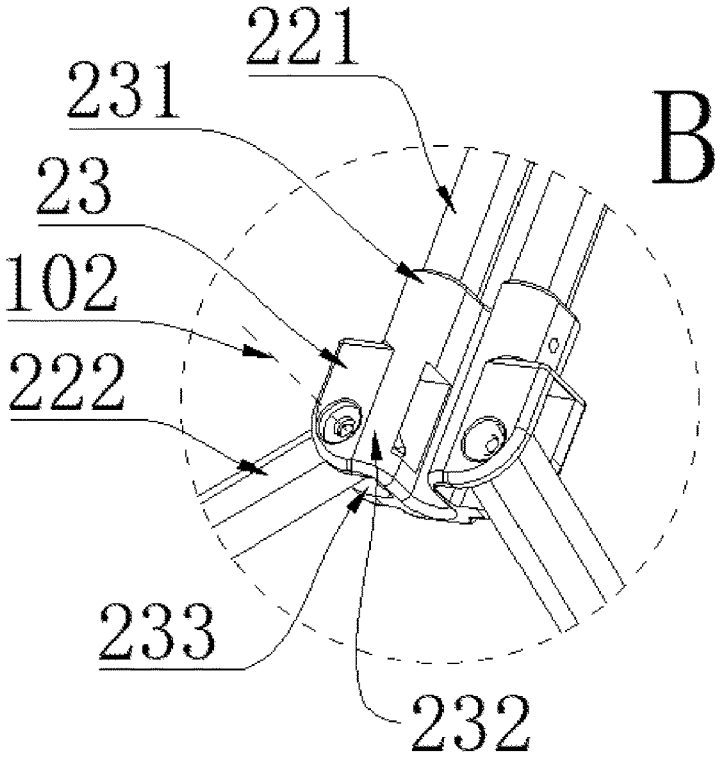
FIG. 4 is an enlarged structural schematic diagram at a portion B in FIG. 3.

In this embodiment, the second upper hip rafter 21 and the connecting hip rafter 221 are disposed around an axis perpendicular to a length direction of them being taken as a rotation axis, that is, an articulated axis of them is parallel to a direction of a connecting line between the two inclined hip rafters 222 in FIG. 3 (that is, a first axis 101 in FIG. 3); and the inclined hip rafters 222 and the second articulated member 23 are disposed around an axis perpendicular to a length direction of the inclined hip rafters 222 being as a rotation axis thereof, that is, an articulated axis of them is a straight line passing through upper ends of the inclined hip rafters 222 and in a direction perpendicular to the plane where the second hip rafters 20 are located (that is, a second axis 102 in FIG. 4).

The first side pole member 121, the second side pole member 122 and the third side pole member 123 are separately composed of X-shaped foldable rafter assemblies, and the number of X-shaped foldable rafter assemblies included by each member can be the same or different. In this embodiment, the first side pole member 121, the second side pole member 122 and the third side pole member 123 each includes an X-shaped foldable rafter assembly, the X-shaped foldable rafter assembly is composed of a first side pole 126 and a second side pole 127 that are articulated with each other therein, ends of the first side pole 126 and the second side pole 127 are articulated with other side pole members, so that the side pole assembly 12 can be unfolded or folded in its length direction.

In other embodiments, when the side pole assembly 12 is composed of an even number of identical X-shaped foldable rafter assemblies, or extendable members may be disposed at the central articulated point of one X-shaped foldable rafter assembly on both the left and right sides of the middle point thereof, so as to make the articulated point located at the upper edge of the side pole assembly 12 in the folded state to facilitate the stability of the folding or unfolding process, and a multi-directional articulated member 24 is articulated with the side pole assembly to realize the purpose of connecting with the second hip rafters 20.

As shown in FIG. 4, in this embodiment, the second articulated member 23 includes a first connecting end 231 and two second articulated seats 232, the first upper hip rafter 131 of the first hip rafter 13 is inserted into the first connecting end 231 and is firmly fixed, and a first articulated groove 233 is formed inside each second articulated seat 232 for rotation of the upper ends of the inclined hip rafters 222 therein.

Figure 5:
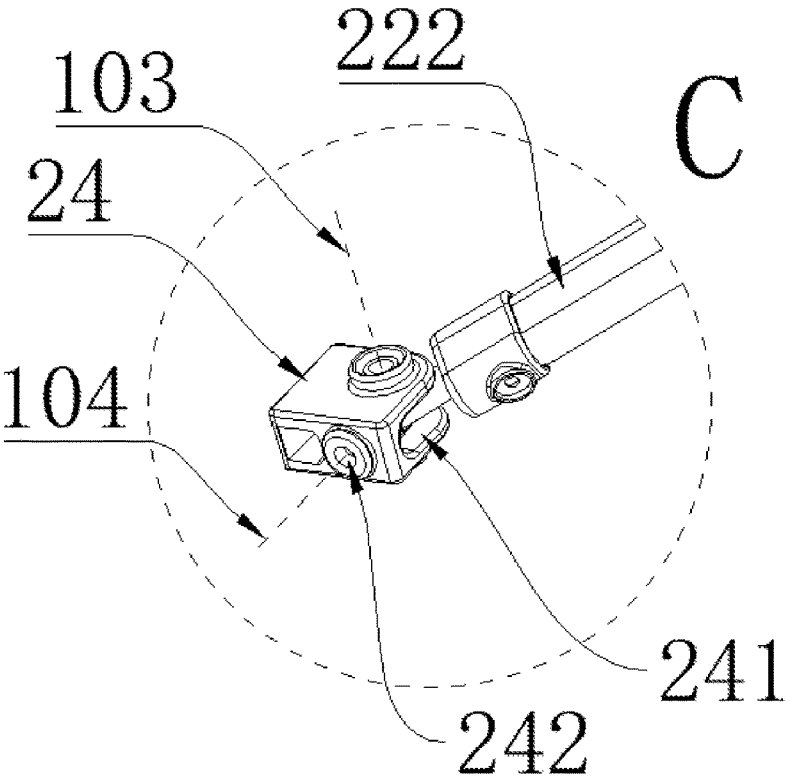
FIG. 5 is an enlarged structural schematic diagram at a portion C in FIG. 3.
Figure 6:
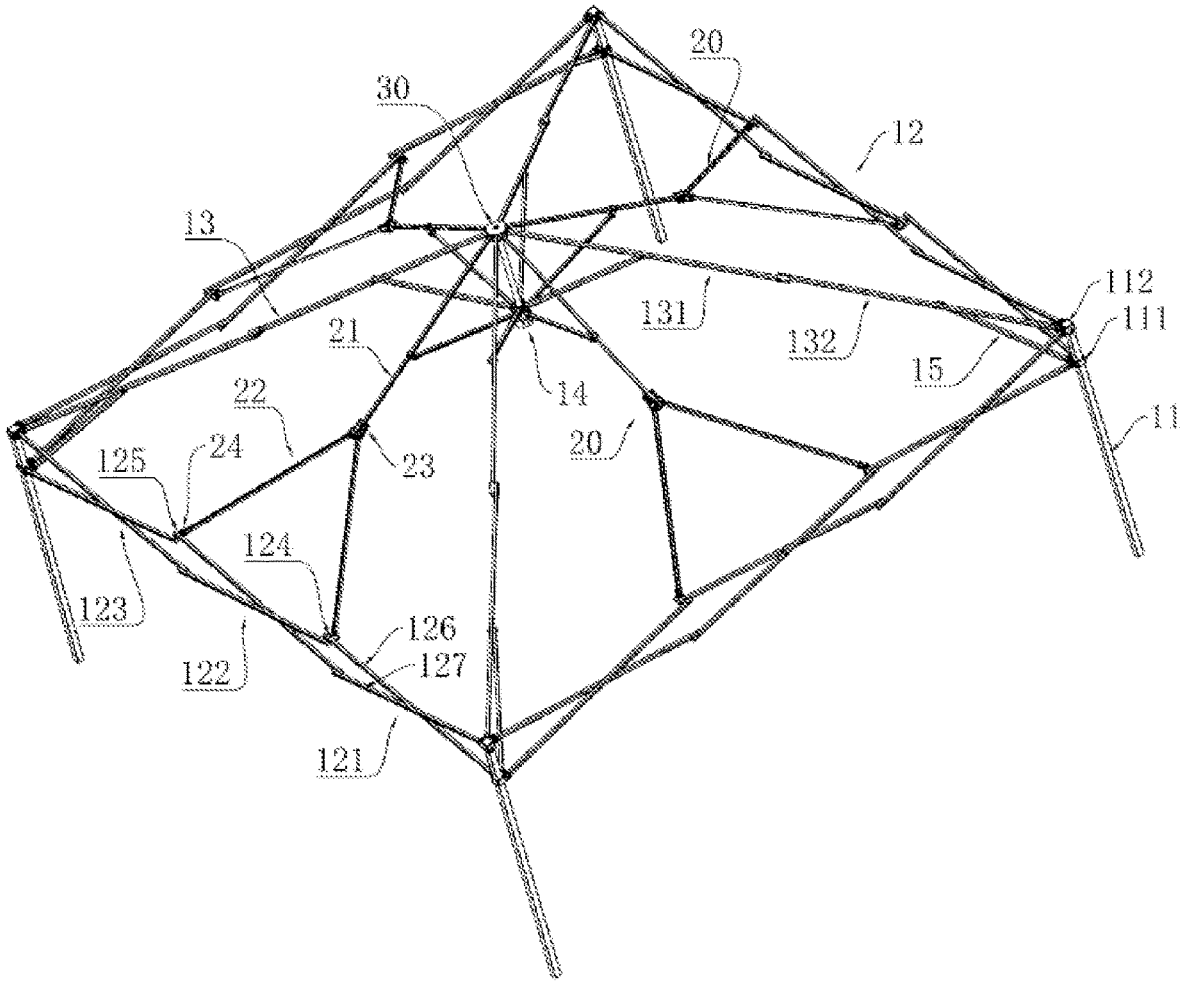
FIG. 6 is a structural schematic diagram of a tent framework in an unfolded state according to Embodiment 2 of the disclosure.
Figure 7:
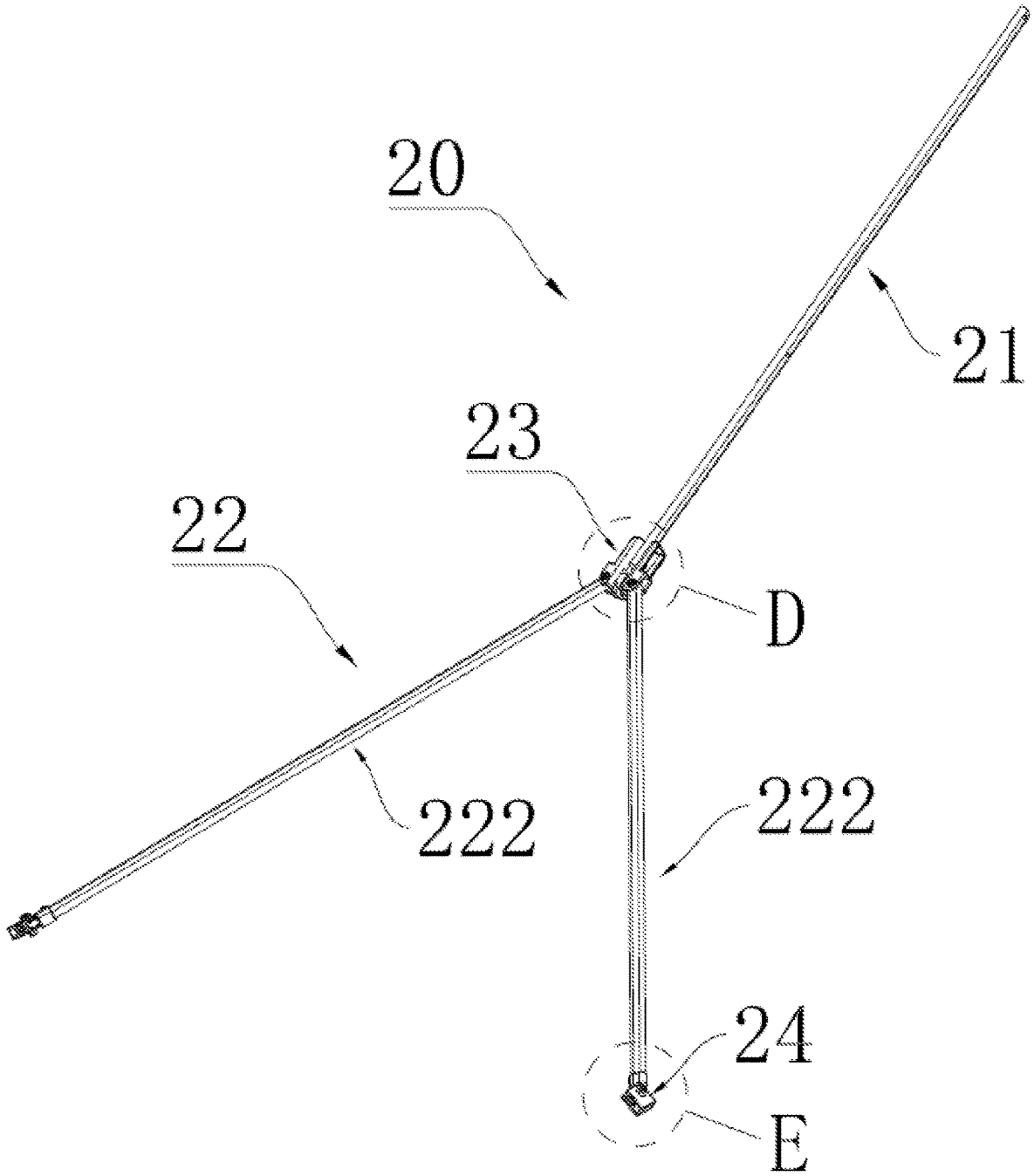
FIG. 7 is a structural schematic diagram of a second hip rafter assembly of an embodiment in FIG. 6.
Figure 8:
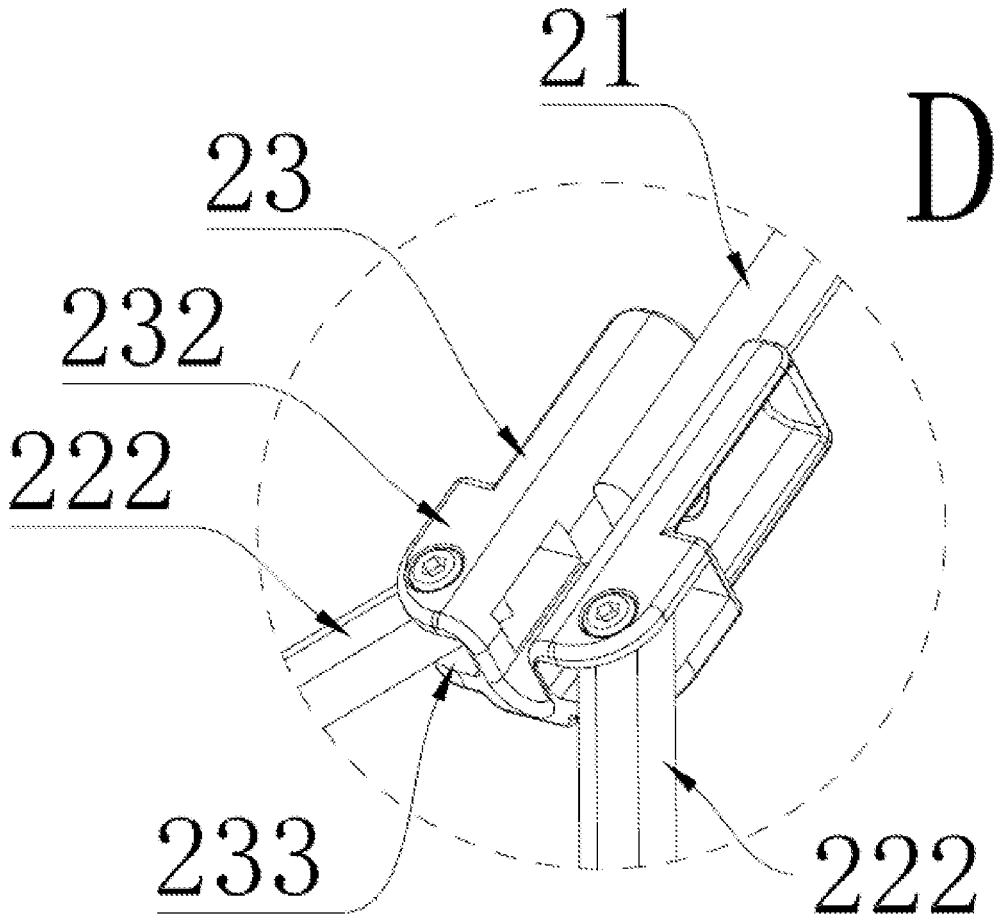
FIG. 8 is an enlarged structural schematic diagram at a portion D in FIG. 7.
Figure 9:
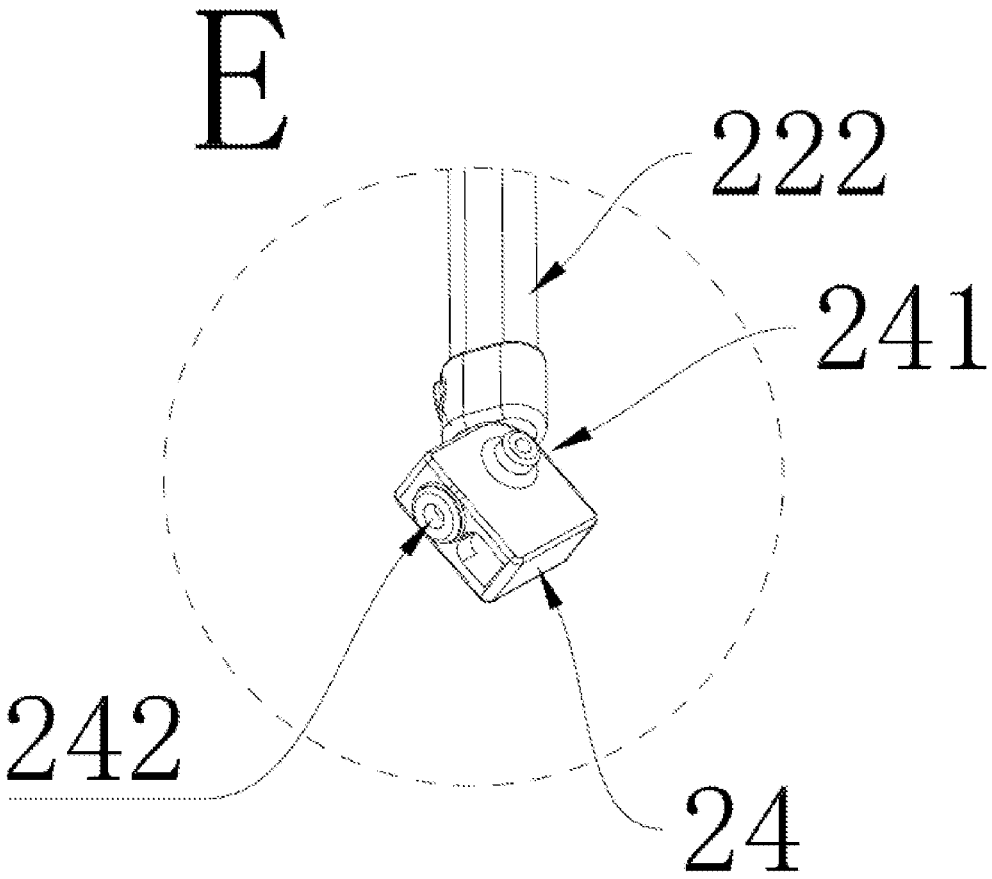
FIG. 9 is an enlarged structural schematic diagram at a portion E in FIG. 7.

As shown in FIG. 5, in this embodiment, the lower end of the inclined hip rafter 222 is connected to the first articulated point 124 or the second articulated point 125 by the multi-directional articulated member 24. The multi-directional articulated member 24 includes a second articulated recess 241 in which the lower ends of the inclined hip rafters 222 is articulated, an articulated hole 242 perpendicular to the rotation axis of the second articulated recess 241, and a joint bolt after passing through the first articulated point 124 or the second articulated point 125 can be rotationally connected to the articulated hole 242, so that the multi-directional articulated member 24 is rotationally connected to the first articulated point 124 or the second articulated point 125 by the joint bolt.

In such a way, an axis between the lower end of the inclined hip rafter 222 and the multi-directional articulated member 24 in a length direction of the inclined hip rafter 222 or perpendicular to a direction of a first surface of the multi-directional articulated member 24 is taken as the rotation axis thereof (that is, a third axis 103 in FIG. 5), and an axis between the multi-directional articulated member 24 and the side pole assembly 12 perpendicular to a direction of the side pole assembly 12 or perpendicular to a direction of a second surface of the multi-directional articulated member 24 is taken as the rotation axis thereof (that is, a fourth axis 104 in FIG. 5). The first surface and the second surface of the multi-directional articulated member 24 are two surfaces perpendicular to each other, so the third axis 103 and the fourth axis 104 are perpendicular to each other.

Therefore, when the tent framework is transformed from the unfolded state to the folded state, each second hip rafter 20 has two actions simultaneously: first, the two inclined hip rafters 222 rotate in their respective upper ends to change from a position away from each other to a position close to each other; second, two ends of the second lower hip rafter 22 are separately rotated relative to the second upper hip rafter 21 and the side pole assembly 12 to fold.

A first articulated seat 112 is fixed at the top of each upright pole 11, and a first slidable seat 111 is arranged along the upright pole 11 in a sliding manner. Ends of the X-shaped foldable rafter assemblies are articulated with each other, an outer end of the second side pole 127 is articulated with the first articulated seat 112, and an outer end of the first side pole 126 is articulated with the first slidable seat 111, so as to allow the side pole assembly 12 to switch between the unfolded state and the folded state by sliding the first slidable seat 111 along the upright pole 11.

The first slidable seat 111 is sleeved on the upright pole 11 for sliding along the upright pole. In other embodiments, a slidable groove and a slider can also be separately arranged on the first slidable seat 111 and the upright pole 11 in a relatively sliding manner.

In this embodiment, a top locking mechanism 14 is disposed below the top connecting member 30. The top locking mechanism 14 includes a locking member 141, a locking vertical bar 142 and a locking supporting pole 143. Two ends of the locking vertical bar 142 are respectively articulated with the first upper hip rafter 131 of the first hip rafter 13 and the locking member 141, the locking member 141 is connected to the locking vertical bar 142 to form a locked state of the locking mechanism 14 when a distance relative to the top connecting member 30 is locked, so that the first hip rafter 13 and the second hip rafter 20 are unfolded and locked. When the locking member 141 is disengaged from the locking supporting pole 143 or extends out of from the locking vertical bar 142 to make the locking member extend, so that the unfolded locking between the first hip rafter 13 and the second hip rafter 20 is released.

In some other embodiments, below the top connecting member 30 is not provided with a top locking mechanism 14, but a lower locking mechanism is disposed between the first slidable seat 111 and the upright pole 11 instead. The lower locking mechanism locks the sliding of the first sliding seat 111 along the upright pole 11, so as to achieve the objective of holding the locking in the unfolded state. The lower locking mechanism may be in a variety of forms, such as passing through a pin through a locking pin hole, or snapping into a locking hole by using a pinball, or by fixing onto the upright pole 11 by using a hoop in a snap-fit manner.

In this embodiment, the tent framework further includes a bottom supporting pole 15. Two ends of the bottom supporting pole 15 are respectively articulated with the first slidable seat 111 and the first lower hip rafter 132 of the first hip rafter 13, so that the bottom supporting pole can play a role in supporting the first hip rafter 13 in the unfolded state.

In some embodiments, the second articulated member 23 is configured to protrude from the top slope where it is located in the unfolded state, and the top slope is a surface formed by the adjacent first hip rafters 13, such that the tent in the unfolded state is not easy to accumulate water at the lower end of each top slope.

Embodiment 2

As shown in FIGS. 6-9, a foldable tent framework has the main structure same as that in Embodiment 1, but differs in that: only the structure of the second hip rafter 20 is different, and more specifically, this embodiment does not include the connecting hip rafter 221 in Embodiment 1.

In this embodiment, the second hip rafter 20 is composed of a second upper hip rafter 21 located at the upper part thereof and a second lower hip rafter 22 located at the lower part thereof, the second lower hip rafter 22 consists of two inclined hip rafters 222, and a second articulated member 23 is disposed between the second upper hip rafter 21 and the second lower hip rafter 22. The upper end of the second upper hip rafter 21 is articulated with a top connecting member 30, the lower end thereof is articulated with the second articulated member 23, upper ends of the two inclined hip rafters 222 are separately articulated with a first articulated groove 233, lower ends thereof are separately articulated with a second articulated groove 241 of a multi-directional articulated member 24, and all articulated structures are the same as those in Embodiment 1, and will not be repeated herein.

Figure 10:
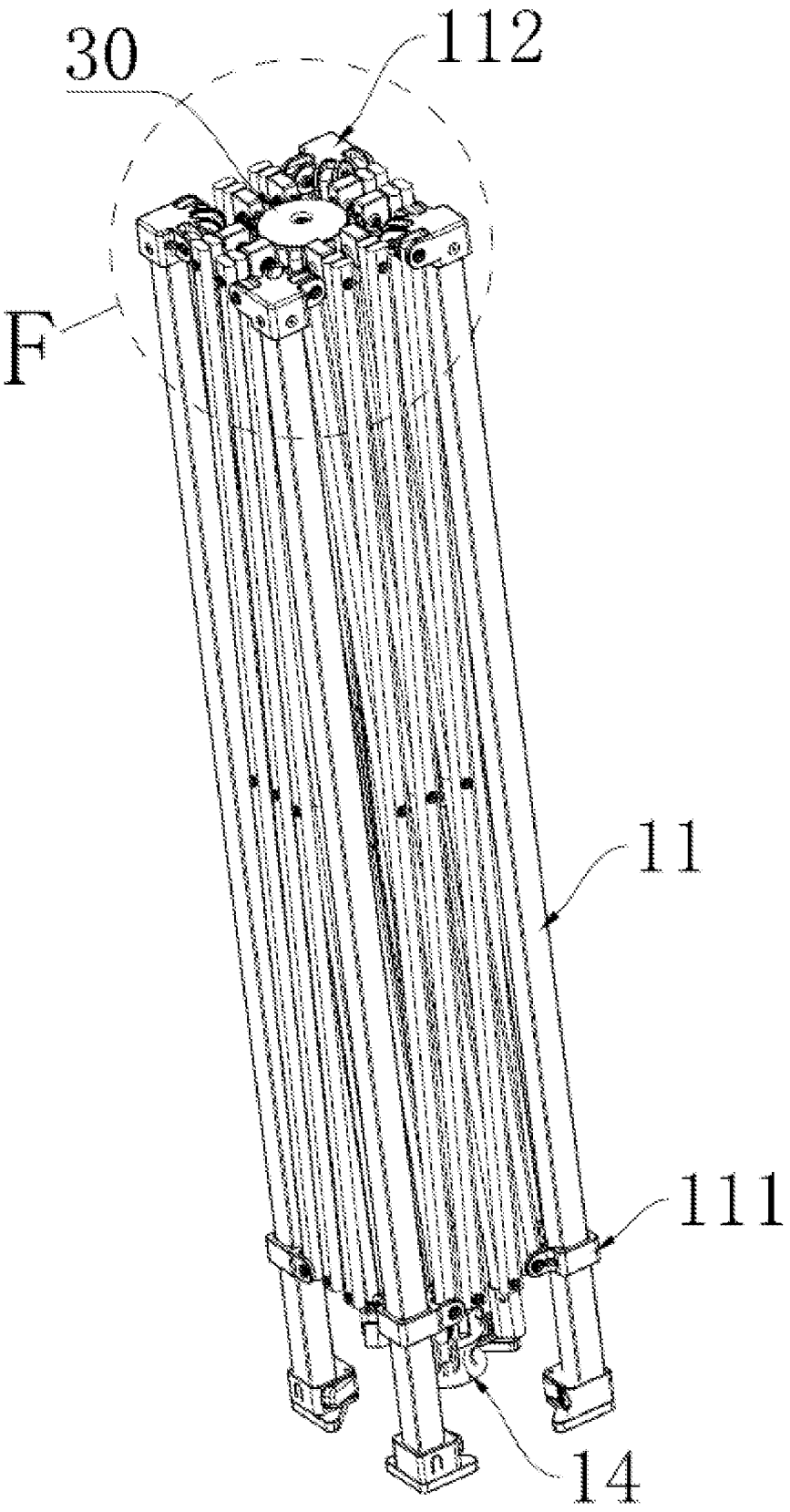
FIG. 10 is a structural schematic diagram of a tent framework in an folded state of an embodiment in FIG. 6.
Figure 11:
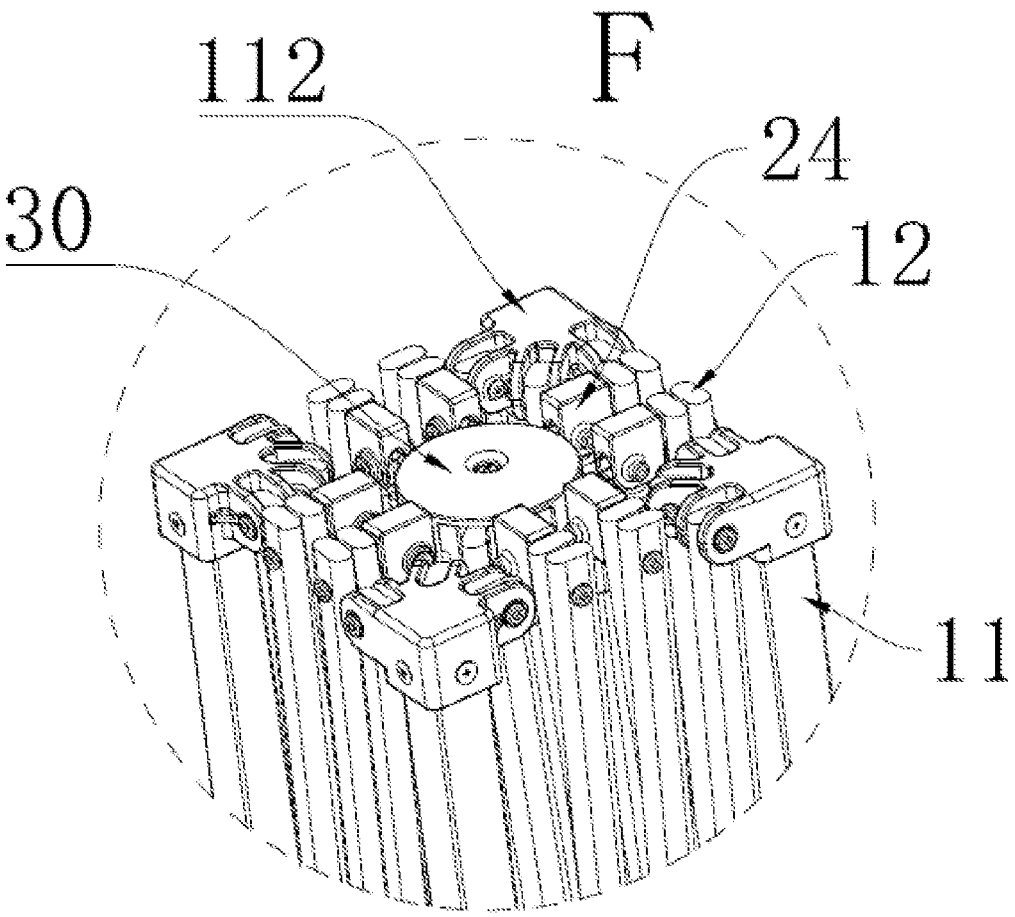
FIG. 11 is an enlarged schematic diagram at a portion F in FIG. 10.
Figure 12:
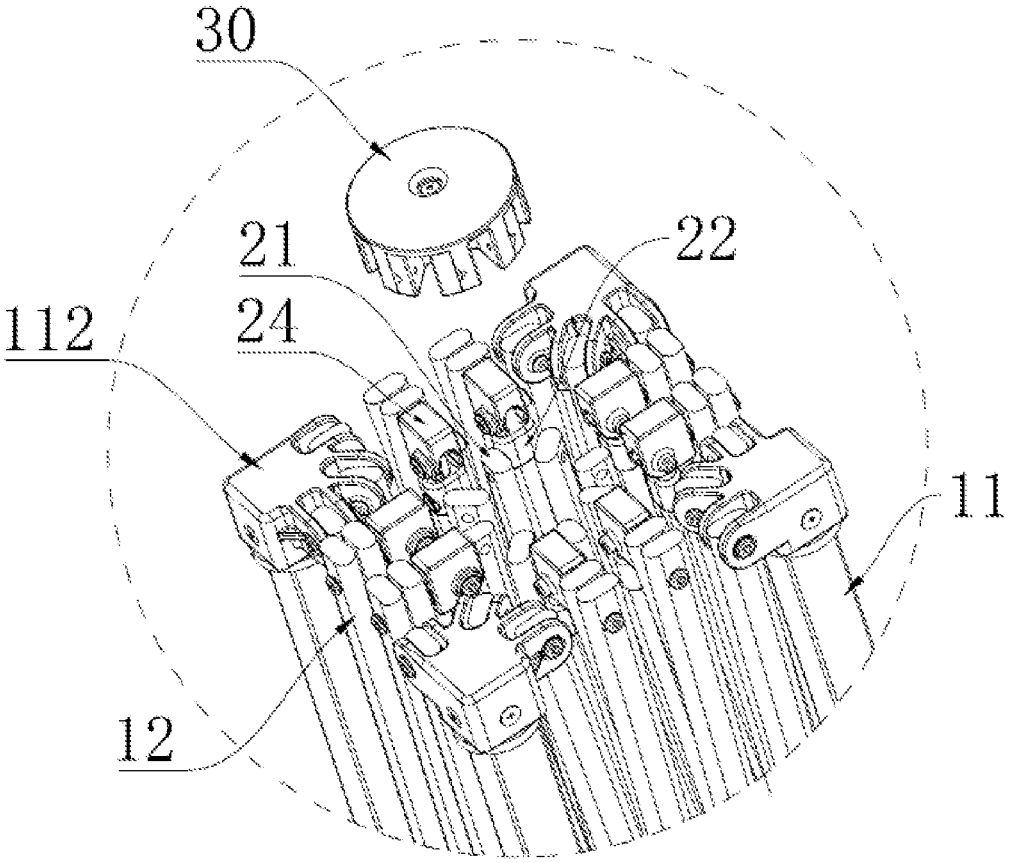
FIG. 12 is a structural exploded view of FIG. 11.

As shown in FIGS. 10-11, the overall length of the foldable tent framework after being folded is equal to that of the upright pole 11, and a side pole assembly 12, a first hip rafter 13, a top locking mechanism 14 and a second hip rafter 20 are close to each other to be folded inside the adjacent upright pole 11, so that the framework has a very small size and volume in the folded state. As shown in FIG. 12, after being folded, each side pole assembly 12 is positioned between adjacent ones to form a quadrilateral shape, and the first hip rafter 13, the top locking mechanism 14 and the second hip rafter 20 are surrounded by each upright pole 11 and the side pole assembly 12.

Figure 13:
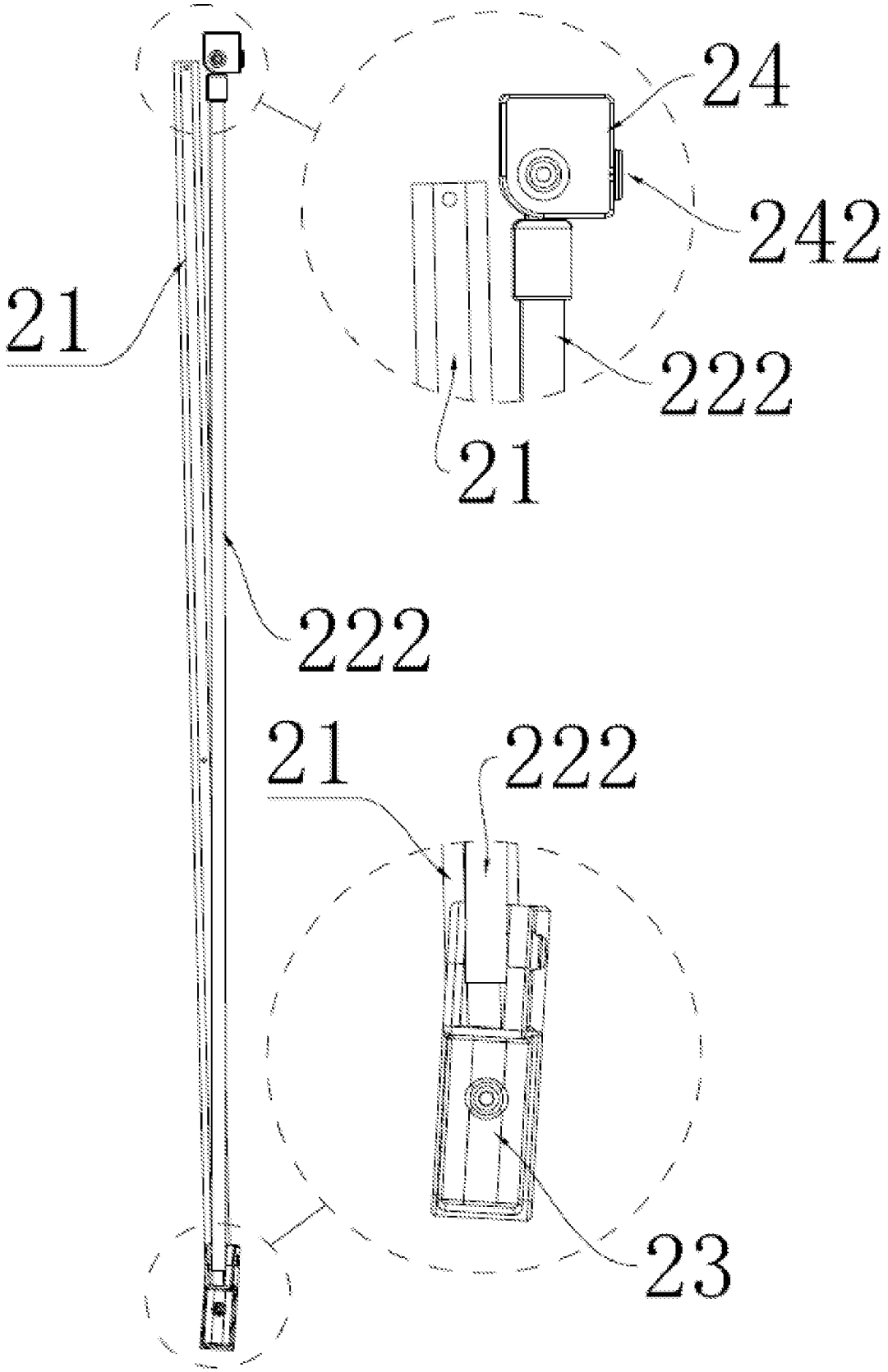
FIG. 13 is a structural schematic diagram of a second hip rafter assembly in a folded state in FIG. 7 and an enlarged schematic diagram of two ends thereof.

As shown in FIG. 13, after being folded, the second upper hip rafter 21 of the second hip rafter 20 and the inclined hip rafter 222 are folded close to each other, and the two are folded at a very small included angle, generally 1-5°, and about 1° in this embodiment. Specific included angle is related to the size of the second hip rafter 20, and the longer the second hip rafter is, the smaller the included angle becomes.

It should be noted that where the connecting hip rafter 221 of the second hip rafter 20 needs to be configured depends on the relationship between the length of the second side pole member 122 in the unfolded state and the length of the inclined hip rafter 222. When the length of the second side pole member 122 in the unfolded state is longer, the connecting hip rafter 221 can be configured to make up the insufficient length of the inclined hip rafter 222, so that the two inclined hip rafters 222 and the second side pole member 122 can form a triangular shape in the unfolded state, and the two inclined hip rafters 222 can also be close or parallel to each other in the folded state.

What is claimed is:

1. A foldable tent framework, comprising:

upright poles;

side pole assemblies connected between the adjacent upright poles;

first hip rafters;

a top connecting member, two ends of each of the first hip rafters respectively connected to one of the upright poles and the top connecting member; and second hip rafters, each of the second hip rafters comprises a second upper hip rafter and a second lower hip rafter, wherein an upper end of second upper hip rafter is connected to the top connecting member, each of the second lower hip rafter comprises two inclined hip rafters arranged adjacently, upper ends of the two inclined hip rafters are articulated with a lower end of the second upper hip rafter, and lower ends of the two inclined hip rafters are respectively connected to a first articulated point and a second articulated point arranged at two sides of the side pole assemblies;

the foldable tent framework has an unfolded state and a folded state; when in the folded state, the two inclined hip rafters are relatively rotated along their respective upper ends to close to each other, and lower ends thereof are close to each other with the folding of the side pole assemblies, and two ends of the second lower hip rafter are respectively rotated relative to the second upper hip rafter and the side pole assemblies for folding;

wherein at least one of an upper end and a lower end of the second lower hip rafter is provided with a universal articulated structure or a multi-axis articulated structure;

wherein two ends of the two inclined hip rafters are respectively connected with the second upper hip rafter and one of the side pole assemblies through a second articulated member and multi-direction articulated members, the lower end of the second upper hip rafter and the upper ends of the two inclined hip rafters are respectively articulated with the second articulated member, the multi-direction articulated members are respectively articulated to the lower ends of the two inclined hip rafters, and the multi-direction articulated members are further articulated to the side pole assemblies; and wherein each of the side pole assemblies comprises a first side pole member, a second side pole member and a third side pole member that are articulated in sequence, the first articulated point is formed between the first side pole member and the second side pole member, the second articulated point is formed between the second side pole member and the third side pole member, and lower ends of the two inclined hip rafters are respectively connected with the first articulated point and the second articulated point; the first side pole member, the second side pole member and the third side pole member each comprises at least one X-shaped foldable rafter assembly, and the X-shaped foldable rafter assembly is composed of a first side pole and a second side pole that are articulated with each other therein.

2. The foldable tent framework according to claim 1, wherein each of the first hip rafters comprises a first upper hip rafter and a first lower hip rafter, and the first upper hip rafter is articulated to the first lower hip rafter; and each of the upright poles is fixedly provided with a first articulated seat and is slidably provided with a first slidable seat, and outer ends of the first side pole and the second side pole are separately articulated to the first articulated seat and the first slidable seat.

3. The foldable tent framework according to claim 2, wherein the tent framework further comprises a bottom supporting pole, two ends of the bottom supporting pole are respectively articulated to the first slidable seat and the first lower hip rafter, so as to support the first hip rafters in the unfolded state.

* * * * *